US006328193B1

(12) United States Patent
Schiff

(10) Patent No.: US 6,328,193 B1
(45) Date of Patent: Dec. 11, 2001

(54) PERSONAL ARTICLE RETENTION SYSTEM

(76) Inventor: R. Schiff, P.O. Box 22, East Otto, NY (US) 14729

( * ) Notice: Subject to any disclaimer, the term of this patent is extended or adjusted under 35 U.S.C. 154(b) by 0 days.

(21) Appl. No.: 09/408,289

(22) Filed: Sep. 29, 1999

(51) Int. Cl.[7] ..... A45F 5/00

(52) U.S. Cl. ..... 224/660; 224/581; 224/582; 24/3.13

(58) Field of Search ..... 224/162, 194, 224/195, 581, 582, 583, 220, 260, 660, 665; 24/3.13; 242/588.1

(56) References Cited

U.S. PATENT DOCUMENTS

| | | | | |
|---|---|---|---|---|
| D. 333,729 | | 3/1993 | Hopp | D3/106 |
| 551,359 | | 12/1895 | Braillard . | |
| 1,048,011 | * | 12/1912 | Wacheneim | 24/3.13 |
| 1,465,281 | | 8/1923 | Morrison . | |
| 1,478,497 | | 12/1923 | Welch . | |
| 1,692,200 | | 11/1928 | Capuano . | |
| 1,716,689 | * | 6/1929 | Freemark | 224/162 |
| 1,729,578 | | 9/1929 | Gogan . | |
| 1,971,571 | * | 8/1934 | McMullen | 224/660 X |
| 3,949,915 | * | 4/1976 | Burhans | 24/3.13 |
| 4,907,729 | | 3/1990 | Hess, III | 224/253 |
| 5,004,136 | | 4/1991 | Leath | 224/253 |
| 5,060,835 | | 10/1991 | Payne | 224/224 |
| 5,070,581 | * | 12/1991 | Senter | 24/3.13 |
| 5,497,818 | * | 3/1996 | Marcarelli | 24/3.13 |
| 5,501,379 | | 3/1996 | Munoz | 224/240 |
| 5,683,022 | | 11/1997 | Evans | 224/583 |
| 5,732,860 | | 3/1998 | Faraj | 224/148.2 |
| 5,833,095 | | 11/1998 | Russell et al. | 224/576 |

* cited by examiner

*Primary Examiner*—Gregory M. Vidovich
(74) *Attorney, Agent, or Firm*—Larry J. Guffey

(57) ABSTRACT

A personal article retention system is disclosed that allows one to transport with minimum risk of loss, valuable personal articles which need to be readily accessible for effective use. In a preferred embodiment, this invention includes a tether having a means on one end that attaches to a personal article of its user. The other end of the tether passes through a first connector body and is then detachably connected to a second connector body, with each of these connector bodies being clamped on either side of the belt or waist portion of the user's clothing.

4 Claims, 6 Drawing Sheets

PERSONAL ARTICLE RETENTION SYSTEM

BACKGROUND OF THE INVENTION

1. Field Of The Invention

The preset invention generally relates to package and article carriers. More particularly, this invention relates to an article retention system having a tether that is connected to a belt strap that encircles some part of a user's body.

2. Description Of The Related Art

Growing numbers of people appear to be concerned that they will misplace and lose valuable portable, personal articles, such as cell phones, pagers, eyeglasses, key chains and wallets. A primary reason for this situation is that more people are choosing to carry with them a greater number of more expensive personal articles, of which there are many more today than ever before, with many people preferring to have these articles at their finger tips for easy use.

Meanwhile, modern clothing is often being configured to be lighter weight and less bulky, thereby providing fewer pockets and space for transporting such personal articles. It also aes to be the case that those who prefer such clothing seldom want to be encumbered with Weighty bags for carrying personal articles; especially when such bags do not usually make such articles readily accessible, nor do they contribute to preventing the situation wherein one just forgets to put a personal article back into the bag after use.

Some work-specific items have been developed to address the related problem of providing one with easy access to items which must be transported, but always within easy reach. For example, we have a night watchman's one end of which contains a key ring, while the other end is attached to some item of the watchmans clothing's. Similarly, many tradesmen wear tool belts which allow them to have their tools constantly at-hand and ready for use.

However, these work-specific items are not well suited for general use by greater numbers of people. The need exists for better means of allowing one to transport, with minimum risk of lost valuable person articles which need to be readily accessible for ease, effectiveness and efficiency of use.

SUMMARY OF THE INVENTION

The object of the present invention is generally directed to satisfying the needs set forth above. The problems of one misplacing or losing transported, easily-accessible personal articles are minimized or resolved by the present invention.

In accordance with one preferred embodiment of the present invention, the foregoing needs can be satisfied by providing a tether with a means on one end for attaching a personal article of its user or a unit for carrying such a personal articles. The other end of the tether passes through a first connector body and is then detachably connected to a second connector body, with each of these connector bodies being attached or clamped to a user's belt or to the waist portion of a user's clothing.

This tether is positionable between an extended and a retracted position. In its retracted position, the tether encircles the waist of its user so that a personal article is held in close proximity to the waist of its user. In its extended position, the tether's detachable end is disconnected so that its other end may be moved away from the user's body to allow an attached personal article to be used more effectively.

In another embodiment, this personal article retention system further includes a second tether having the ability to attach a second personal article, while utilizing the same or similar connector bodies. In a further embodiment, these connector bodies are attached to a belt that is Worn by the system user and around which the tethers reside in their retracted position. Such a belt may be especially configured to allow it to be twice wrapped about the user's waist, with the tethers and connectors being positioned on the outer wrap of the belt.

These retention systems seen to achieve their objects of minimizing the risk that transported, readily accessible, personal articles will be lost. Other objects and advantages of this invention will become readily apparent as the invention is better understood by reference to the accompanying drawings and the detailed description that follows.

DESCRIPTION OF THE PREFERRED EMBODIMENT

Figure 1:
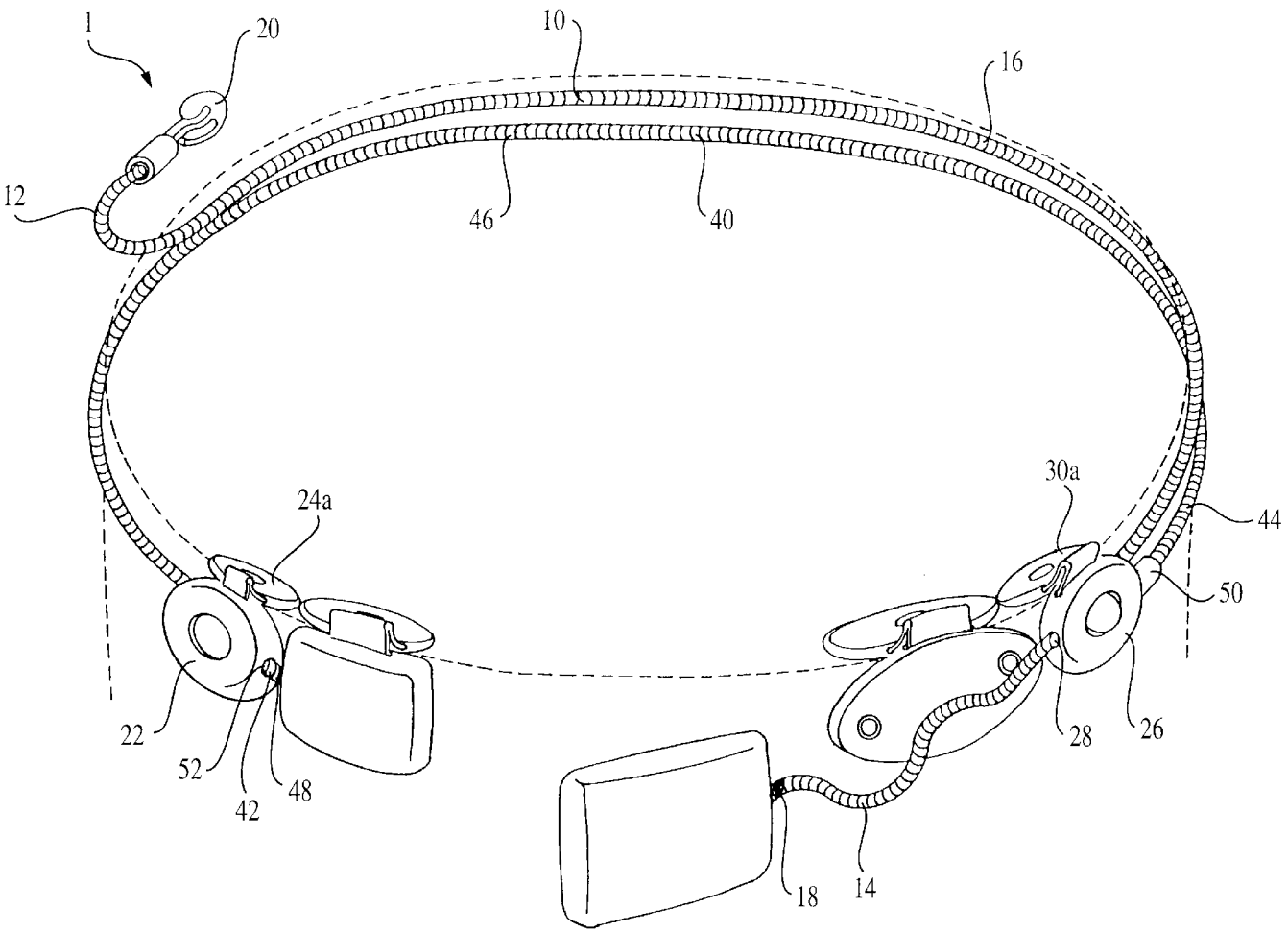
FIG. 1 is a perspective view of a preferred embodiment of the present invention having two tethers and two clothing attaching means (24).

Referring now to the drawings wherein are shown preferred embodiments and wherein like reference numerals designate like elements throughout, there is shown in FIG. 1 a preferred embodiment of a personal article retention system.

For this embodiment, the system is seen to comprise: (a) two tethers (10,40), each of which has two ends (12, 14 and 42, 44) and a central section(16 and 46), respectively and each of which has a personal article attaching means (18, 48) affixed to one of the tethers for attaching personal articles, and (b) two connector bodies (22, 26)that have respective passages (28, 52) through which one of the tethers passes while the other tether detachably connects to the connector body, wherein each body has a clothing attaching means(24, 30) for clamping the bodies to the waist portion of the clothing of a system user, with the bodies being configured so to couple with means (20, 50) provided at the other end of the tethers for detachably coupling these ends to the connector bodies.

The clothing attaching means(24, 30) are seen in FIGS. 1, 2, 3 and 5 to be possible of taking many different forms, including a simple type of clasp (24*a*, 30*a* and 24*d*) and a fold over wrap (24*b*, 30*b* and 24*c*, 30*c*).

These tethers are each seen to be positionable between an extended and a retracted position. In their retracted positions, the tethers are wrapped around the waist of the system user and any attached personal articles,such as a key case or wallet, are held close to the user's body. In their extended positions, the coupled tether ends are uncoupled from their connector bodies which allows their other ends with attached personal articles to be extended out from the user's body to allow for the effective use of the personal article.

Thus, to extend the personal article shown on the right side of FIG. 1, the user has decoupled the end of the tether that had been coupled to the connector body (22) shown on the left side of FIG. 1.

Figure 2:
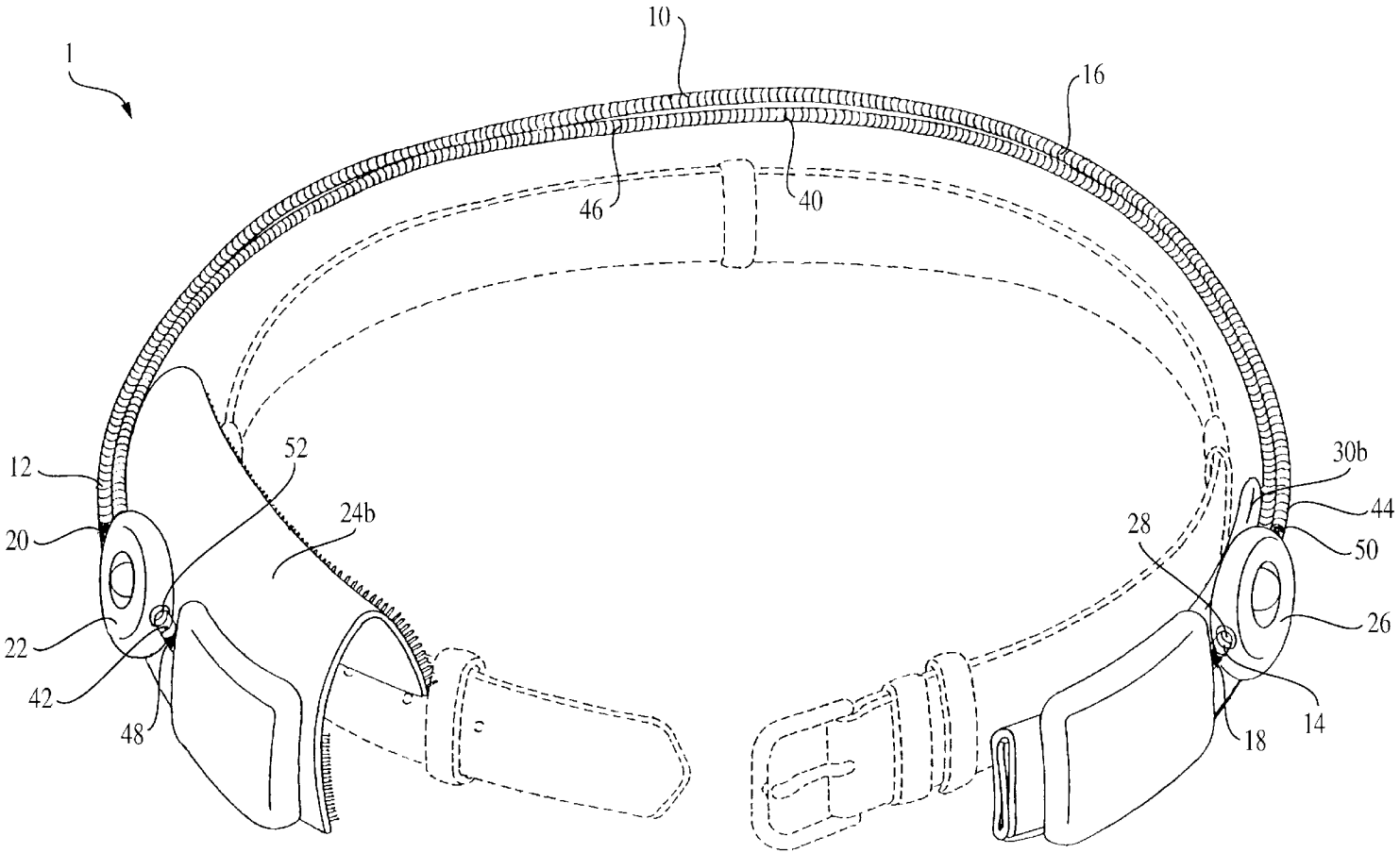
FIG. 2 illustrates an embodiment similar to that shown in FIG. 1 having a second alternative clothing attaching means.
Figure 3:
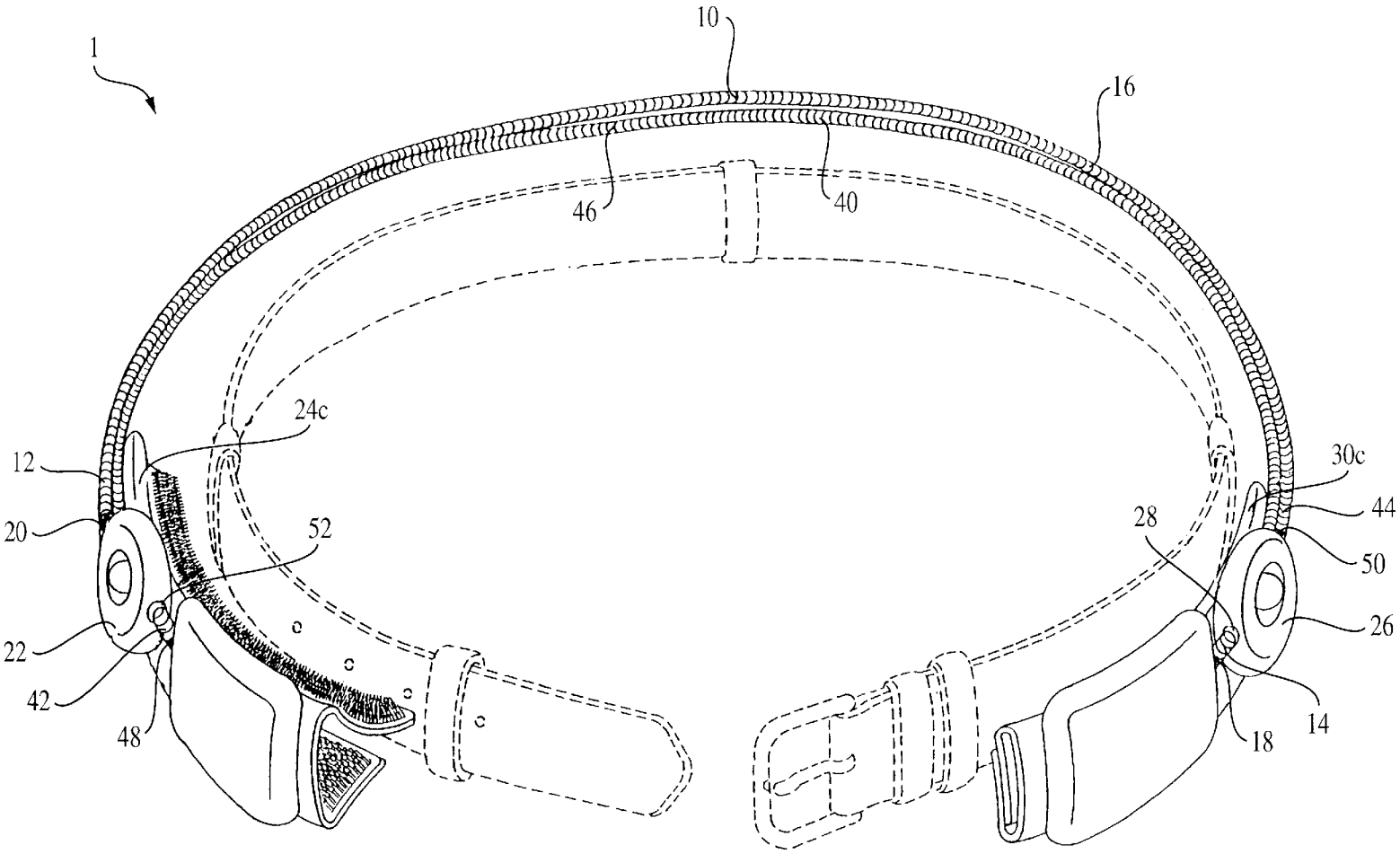
FIG. 3 illustrates an embodiment similar to that shown in FIG. 1 having a third alternative clothing attatching means.

FIGS. 2 and 3 illustrate alternative system embodiments that utilize differing means for clamping the connectors to clothing, including the traditional belt, worn around the waist of a system user.

All of these embodiments show the system being used with personal articles (i.e., a key case and a micro-wallet) that have been especially designed for compatibility with the system.

Figure 4:
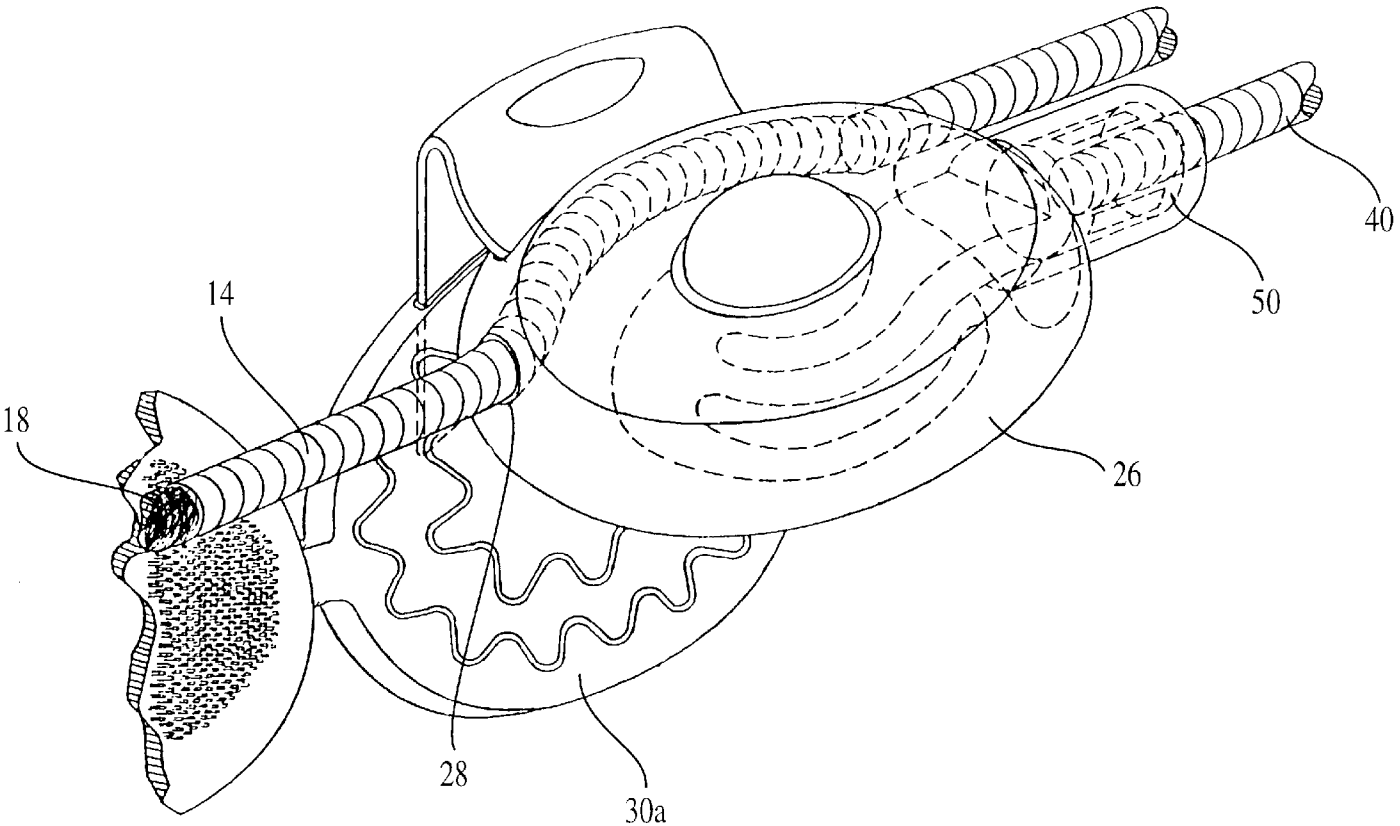
FIG. 4 is a perspective view of a key element of the present invention: a connector body (22) that has incorporated into its design one version of a clothing attatching means (24).
Figure 5:
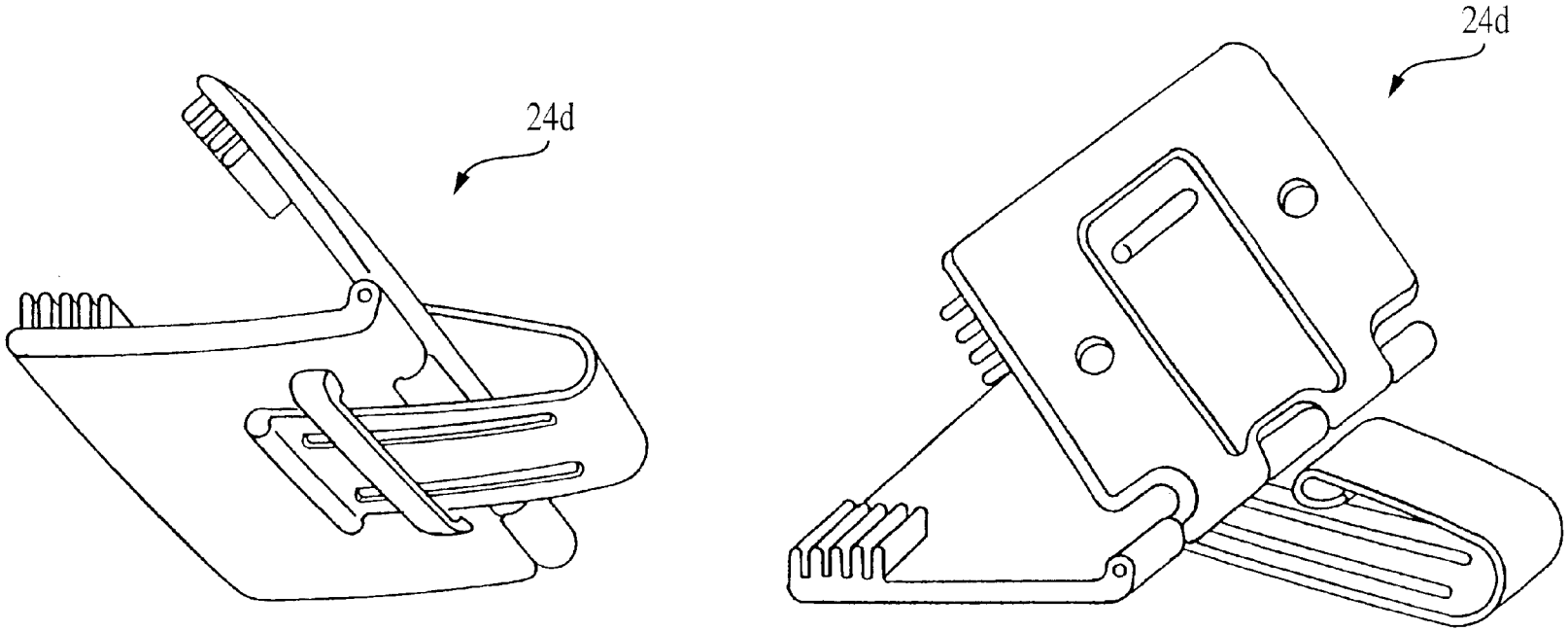
FIG. 5 illustrates a key element of the present invention: a preferred version of a clothing attaching means (24) for attaching or clamping a connector body to a user's belt or the waist portion of a user's clothing.
Figure 6A:
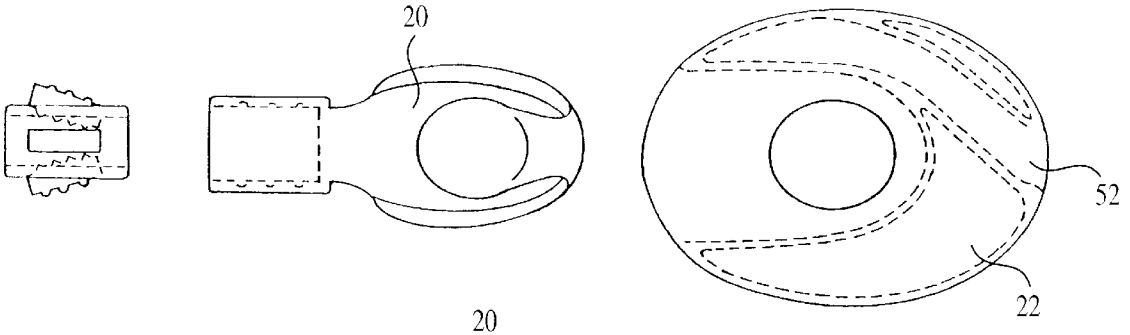
FIGS. 6(*a*)–6(*c*) show top, side and perspective views of a key element of the present invention: a preferred embodiment of the present Invention's connector body and a means for coupling with a tether end.
Figure 6B:
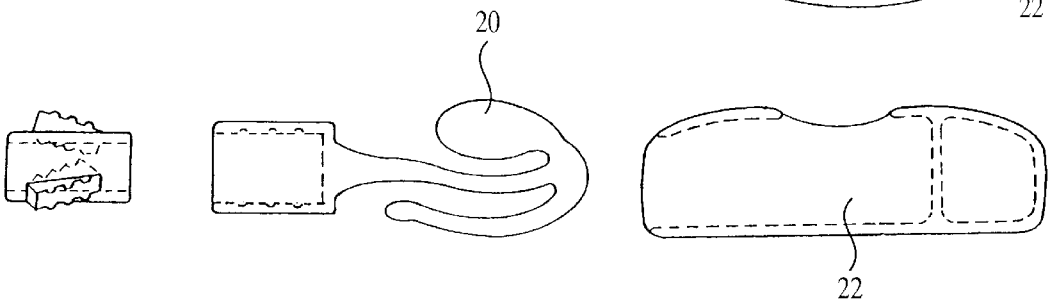
Figure 6C:
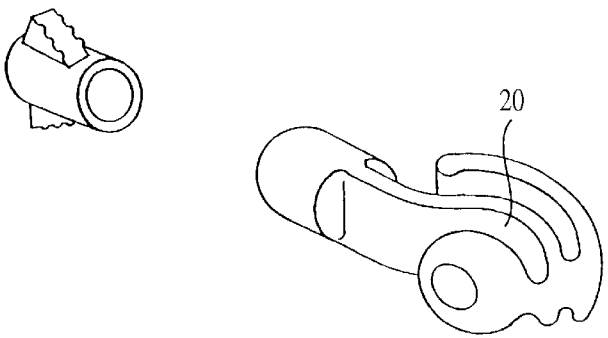
Figure 6:
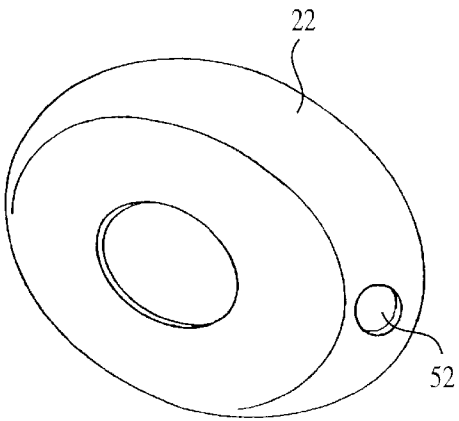

FIGS. 4 through 6 show, in more detail, key elements of the present invention: clothing attaching means (24, 30) and connector bodies(22, 26). FIG. 4 shows a connector body (26) having a passage (28) through which the central section (16) of a tether passes so that its second end (14) and its personal article attaching means (18) can attach to a user's personal article of choice. Also shown are how a second tether's end (44) and its coupling means (50) detachably couples with the connector body (26). FIG. 6 shows in more detail the structure of a representative connector body and a coupling means. Meanwhile, FIG. 5 shows an alternative design for a clasping-type of clothing attaching means**(24*d*)**. Suitable materials of construction for these parts include plastic and metal, with their sizing being such as to be compatible with tethers constructed from materials including nylon or other plastic cordage, leather cord and woven cotton tubing.

FIGS. 12 and 13 show another version of this type of double-wrapped belt which utilizes only a single, long piece of belt and a set of D-rings (108) that enable the belt to be double-wrapped. These figures are especially noteworthy as they also show a backpack being retained by the system, with the backpack being mountable on a portion of the outer belt side that adjoins the user's back.

Although the embodiments previously disclosed have all involve their use around a user's waist, the present invention is not restricted to only such use. Other related inventions of it can be wrapped around a portion of a user's limbs or even be used to help hold and control the user's hair.

FIGS. 14 and 15 show a related invention that has been configured to be worn around the waist of its user. It consists of (a) an elongated strap (110), (b) a means (120), such as hook and loop tabs, for securing together the ends of the strap after it has been wrapped around a limb of its user, (c) a tether (122) which attaches on one end to a personal article and on the other end to the strap, and (d) a means (134), such a looped cord, slidably attached to the strap's inner for facilitating the holding of the strap while it is being wrapped around the user's limb.

FIG. 16 shows another related invention that has been configured for use in one's hair. The looped cord (134) is especially useful in this version as its user places the thumb and forefinger of one hand in the configured loops to hold one end of the strap stationary. Meanwhile, the other hand wraps the other end of the strap around a lock of hair. Materials suitable for the strap'construction include an elasticized webbing with a weave comprising raised, nappy fibers that can act as the loop end catch in a hook and loop fastener system.

Yet another related invention can be configured for use in retaining sheath instruments. FIGS. 17 and 18 show such an embodiment. It is seen to consist of: (a) cooperating straps (140, 160) that are wrapped around the limb to which the instrument is to be restrained and placed at a separation distance which allows for support of the elongated instrument near its ends, (b) a tether (150) which attaches by suitable means (156) on one end to the exposed head of the sheathed instrument and on the other end to the strap (140) nearest the eposed head, (c) a means (170) affixed to the other strap (160) for detachably coupling the enclosing end of the instrument's sheath to this strap (160), (d) a connector (172), affixed to the strap nearest the exposed head, about which the mid-point of the tether can be held when the instrument is in its retracted position, and (e) a length-adjustable linkage (174) between the straps that provides a buffer between the sheathed instrument and one's limb, while also providing a further means (176) for detachably securing the sheath to one's limb. For instruments or tools not accompanied by sheaths, this embodiment could easily include a built-in sheath.

Materials and elements suitable for this embodiment include elasticized webbing for the strap worn at the wrist and surgical tubing for the strap worn near the elbow, a rubberized O-ring-type connector for grabbing the exposed end of the instrument, and an elastomeric catch hook about which the mid-point of the teter is wrapped.

As previously mentioned, the key case and micro-wallet that have been consistently shown throughout these figures were especially designed for compatibility with the system. More details on the construction of these articles are provided in FIG. 19.

The key case is preferably made from a single strip of elasticized webbing, including a hidden pocket underneath the panel on which the keys are lain. Hook and loop material is used to fasten the top portion of this hidden pocket.

This especially thin wallet is preferably constructed of a single long strip (approximately 19 inches×3.5 inches) of nylon tape, folded into three, elongated panels (A, B, C). Two smaller panels (D, E) and a nylon zipper (F) act together to make a space between panels B and C into a zippered compartment. The stitching for the wallet provides for two credit card holding compartments between the remainder of panels B and C, with a paper money holding compartment between panels A and B. Two slots (G, H) are provided to enable one to dislodge tightly fitting credit cards, and hook and loop fastener materials are used for holding the folded wallet closed and for attaching it to a system belt.

Although the foregoing disclosure relates to preferred embodiments of the invention, it is understood that these details have been given for the purposes of clarification only. Various changes and modification of the invention will be apparent, to one having ordinary skill in the art without departing from the spirit and scope of the invention as hereinafter set forth in the claims.

I claim:

1. A personal article retention system (1) comprising:

a tether (10) having first (12) and second (14) ends and a central section (16), a personal article attaching means (18) affixed to said second end (14) for attaching a first personal article to said second tether end (14), a coupling means (20) affixed to said first tether end (12), a first connector body (22) configured to couple with said coupling means (20) for detachably coupling said first tether end (12) to said first connector body (22), said first connector body (22) having an affixed first clothing attaching means (24) that allows said connector body (22) to be detachably attached to a first position on a portion of the clothing being worn by a system user, a second connector body (26) having a passage (28) through which the central section (16) of said tether (10) may slide, said second connector body (26) having an affixed second clothing attaching means (30) that allows said connector body (26) to be detachably attached to a second position on a portion of the clothing being worn by a system user, said tether (10) being positionable between an extended and a retracted position, wherein said second position of said second connector body (26) being situated so as to be in operative relation to the first position of said first connector body (22) when said tether (10) is moved between its retracted and extended positions, wherein said tether (10) in its retracted position has said first end coupling means (20) detachably coupled to said first connector body (22), with the central section of said tether (10) wrapped around said user and having said second end (14) passed through said second connector body passage (28) and in close proximity to said second connector body (26), and wherein said tether (10) in its extended position has said first end coupling means (20) uncoupled from said first connector body (22), with the central section (16) of said tether (10) having been slid through said second connector body passage (28) so that said second tether end (14) is extended so that said attached first personal article may be used at a position distant from said second connector body (26) which remains attached to a portion of the clothing of said system user.

2. A personal article retention system (1) as recited in claim 1, further comprising:

a second tether (40) having first (42) and second (44) ends and a central section (46), a second personal article attaching means (48) affixed to said first end (42) for attaching a second personal article to said first tether end (42), a coupling means (50) affixed to said second tether end (44), wherein said second connector body (26) configured to couple with said coupling means (50) for detachably coupling said second tether end (44) to said second connector body (26), wherein said first connector body (22) further having a passage (52) through which the central section (46) of said second tether (40) may slide, said second tether (40) having its central section (46) wrapped around said user, with said tether (40) being positionable between an extended and a retracted position, wherein said second tether (40) in its retracted position has said coupling means (50) detachably coupled to said second connector body (26), with the central section of said tether (40) wrapped around said user and having said first tether end (42) passed through said first connector body passage (52) and in close proximity to said first connector body (22), and wherein said second tether (40) in its extended position has said second end coupling means (50) uncoupled from said second connector body (26), with the central section (46) of said tether (40) having been slid through said first connector body passage (52) so that said first tether end (42) is extended so that said attached second personal article may be used at a position distant from said first connector body (22) which remains attached to the clothing of said system user.

3. A personal article retention system (1) as recited in claim 1, wherein:

said personal article is chosen from the group of specially configured items for use with said system, said group consisting of a key case and a wallet.

4. A personal article retention system (1) as recited in claim 2, wherein:

said personal articles for attachment to said first and second tethers are chosen from the group of specially configured items for use with said system, said group consisting of a key case and a wallet.

* * * * *